US012372088B1

(12) United States Patent
Picouet et al.

(10) Patent No.: US 12,372,088 B1
(45) Date of Patent: Jul. 29, 2025

(54) SELF-POSITIONING VOLUME SLIDE CONTROL WITH POSITION FEEDBACK FOR SCREW COMPRESSOR

(71) Applicant: Copeland Industrial LP, St. Louis, MO (US)

(72) Inventors: Jean-Louis Picouet, Waukesha, WI (US); Steven Fels, West Allis, WI (US); Abhijit Pande, Pune (IN); Pallavi Narkhede, Pune (IN)

(73) Assignee: Copeland Industrial LP

( * ) Notice: Subject to any disclaimer, the term of this patent is extended or adjusted under 35 U.S.C. 154(b) by 0 days.

(21) Appl. No.: 18/675,818

(22) Filed: May 28, 2024

(51) Int. Cl.
*F04C 18/16* (2006.01)
*F04C 18/52* (2006.01)
*F04C 28/12* (2006.01)

(52) U.S. Cl.
CPC ..... *F04C 18/16* (2013.01); *F04C 18/52* (2013.01); *F04C 28/12* (2013.01)

(58) Field of Classification Search
CPC ..... F04C 18/16; F04C 18/52; F04C 28/12
See application file for complete search history.

(56) References Cited

U.S. PATENT DOCUMENTS

| | | | |
|---|---|---|---|
| 774,551 | A | 11/1904 | Beaumont |
| 3,088,659 | A | 5/1963 | Nilsson et al. |
| 3,108,740 | A | 10/1963 | Schibbye |
| 3,151,806 | A | 10/1964 | Whitfield |
| 3,314,597 | A | 4/1967 | Schibbye |
| 3,756,753 | A | 9/1973 | Persson et al. |
| 3,810,715 | A | 5/1974 | Week et al. |
| 3,936,239 | A | 2/1976 | Shaw |
| RE29,283 | E | 6/1977 | Shaw |
| 4,220,197 | A | 9/1980 | Schaefer |
| 4,261,691 | A | 4/1981 | Zimmern et al. |
| 4,455,131 | A | 6/1984 | Werner-Larson |
| 4,478,054 | A | 10/1984 | Shaw |
| 4,583,373 | A | 4/1986 | Shaw |
| 4,597,726 | A | 7/1986 | Soderlund |
| 4,610,612 | A | 9/1986 | Kocher |
| 4,610,613 | A | 9/1986 | Szymaszek |
| 4,611,976 | A | 9/1986 | Schibbye et al. |
| 4,704,069 | A | 11/1987 | Kocher et al. |
| 4,842,501 | A | 6/1989 | Schibbye |

(Continued)

FOREIGN PATENT DOCUMENTS

| | | |
|---|---|---|
| JP | 57195889 | 12/1982 |
| WO | 2006085866 | 8/2006 |

*Primary Examiner* — Mary A Davis
(74) *Attorney, Agent, or Firm* — Amundsen Davis, LLC

(57) ABSTRACT

Slide valve assemblies are provided that have volume slide valve members that are self-positioning, as well as compressors that include such slide-valve assemblies. The self-positioning volume slide valve member automatically slidably adjusts to control compressor volume ratio and power input to the compressor during normal operation of the compressor. A positioning guide assembly includes a pinion gear and a movable rackshaft. The rackshaft engages the volume slide valve member and moves the volume slide valve member to an initial position when the rackshaft moves from a first position to a second position. Thus, the volume slide valve member may be placed in its initial position prior to normal operation of the compressor.

18 Claims, 9 Drawing Sheets

(56) References Cited

U.S. PATENT DOCUMENTS

| | | | | |
|---|---|---|---|---|
| 5,183,395 | A * | 2/1993 | Langouet | F04C 18/16 417/310 |
| 5,435,704 | A | 7/1995 | Sawyer | |
| 6,106,241 | A | 8/2000 | Zimmern | |
| 7,798,793 | B2 | 9/2010 | Shoulders | |
| 7,891,955 | B2 | 2/2011 | Picouet | |
| 8,202,060 | B2 | 6/2012 | Picouet | |
| 2006/0008375 | A1 | 1/2006 | Hasegawa | |
| 2008/0206075 | A1 | 8/2008 | Picouet | |
| 2010/0284848 | A1 | 11/2010 | Fujiwara et al. | |
| 2023/0027313 | A1 | 1/2023 | Picouet et al. | |

* cited by examiner

SELF-POSITIONING VOLUME SLIDE CONTROL WITH POSITION FEEDBACK FOR SCREW COMPRESSOR

FIELD OF THE INVENTION

The present technology relates to compressors and slide valve assemblies for compressors, and more particularly to slide valve assemblies having an self-positioning volume slide valve member and positioning assemblies for use with self-positioning volume slide valve members.

BACKGROUND

Compressors (e.g., rotary screw gas compressors) are used, for example, in compression systems (e.g., refrigeration systems) to compress refrigerant gas, such as "Freon", ammonia, natural gas, or the like. One type of rotary gas compressor employs a housing in which a motor-driven single main rotor having spiral grooves thereon that mesh with a pair of gate or star rotors on opposite sides of the rotor to define gas compression chambers. The housing is provided with two gas suction ports (one near each gate rotor) and with two gas discharge ports (one near each gate rotor). Two dual slide valve assemblies are provided on the housing (one assembly near each gate rotor) and each slide valve assembly comprises a suction slide valve (also referred to as a "capacity slide valve") and a discharge slide valve (also referred to as a "volume slide valve"), for controlling an associated suction port and an associated discharge port, respectively. Generally, the capacity slide valves and the volume slide valves are moved independently by controllers, such as, for example, electrical or hydraulic controllers/motors. U.S. Pat. Nos. 4,610,612, 4,610,613, 4,704,069, 7,891,955, and 8,202,060, all of which are assigned to the same assignee as the present application, disclose a dual-slide valve rotary gas compressor of the kind described above. The teachings and disclosures of each of these patents are incorporated by reference in their entireties herein.

During operation of such single screw compressors, a small amount of oil is continuously supplied to the compression chambers to provide an oil seal at points where the main rotor meshes with the gate rotors and with the housing to thereby effectively seal the chambers against gas leakage during gas compression. The oil flows out through the discharge ports and is recovered and recirculated. When the compressor is shutdown and coasting to rest, excess oil can collect or settle in the compression chambers. When the compressor is restarted, the residual oil in the compression chambers, plus fresh oil entering the compression chambers, must be expelled through the discharge ports. In certain instances where the compressor is started with too much liquid in it, there is considerable pressure generated into the grooves of the screw because those grooves are attempting to compress a non-compressible fluid instead of the compressible refrigerant gas. Such a situation is generally known "liquid lock," which can cause degradation of the performances of the compressor, and sometimes results in the compressor stalling because the motor cannot turn the screw.

A compressor 10 having a dual slide assembly 12, of the type shown in U.S. Pat. No. 7,891,955, is illustrated in FIG. 1 (Prior Art). Specifically, FIG. 1 shows the mechanisms for moving the slide valves 14 and 16 are shown in FIG. 1. The assembly 12 includes rackshaft 18 which includes rack teeth 20 thereon. Pinion gear 22 engages rack teeth 20 on the side of slide rackshaft 18 which has one end rigidly secured to the end edge 24 of the slide valve member 14 of the slide valve assembly 12. Similarly, slide valve member 16 is moved using rackshaft 26. Rackshaft 26 includes rack teeth 28 thereon, and pinion gear 30 engages the rack teeth on the side of the rod which has an end rigidly secured to the end edge 32 of slide member 16. Controller mechanisms (not shown) are connected to each of the pinion gears 22 and 30 and are used to effect the slide valve movement the slide valves 14 and 16.

Each dual-purpose capacity and volume slide valve member 14, 16 is slidably positionable (between full load and part load positions) relative to the port 36 to control where low pressure uncompressed gas from gas inlet passage 38 is admitted to the compression chambers or grooves of main rotor to thereby function as a suction by-pass to control compressor capacity. Each volume slide valve member 16 is slidably positionable (between minimum and adjusted volume ratio positions) relative to the discharge/volume port 40 to control where, along the compression chambers or grooves, high pressure compressed gas is expelled from the compression chambers, through discharge/volume port 40 to a gas exhaust passage to thereby control the input power to the compressor. The slide valve members 14 and 16 are independently movable by the separate controllers (not shown) that are connected to pinion gears 22 and 30. A known control means or system is used to cause the controllers to position the slide valves 14 and 16 for compressor start-up. The control means or system operates the controllers to position and reposition the slide valve members 14 and 16, as needed, to cause the compressor to operate at a predetermined capacity and a predetermined power input.

Typical slide valve assemblies, such as the one shown in FIG. 1, use one or more controllers connected to pinion gears in combination with shafts, gears and a rackshaft to control the position of each of the capacity slide valve member 14 and the volume slide valve member 16. The controllers are programmed to position the valve members based on a number of factors, including for example, the compressor capacity (0 to 100%) and the internal pressures (suction and discharge).

FIG. 2 shows a perspective view of another example of a carriage and slide valve members of a prior art slide valve assembly 100. The slide valve assembly 100 includes a carriage 102, as well as two movable slide valve members or mechanisms, namely, a capacity slide valve member 104 and a volume slide valve member 106. The capacity slide valve member 104 is connected to a first rackshaft 110, which is driven by a controller (not shown) to move the capacity slide valve member 104 along its axis of movement to a desired position. The volume slide valve member 106 is connected to a second rackshaft 108, which is driven by a controller (not shown) to move the volume slide valve member 106 along its axis of movement to a desired position.

U.S. Pub No. 20230027313, the disclosure of which is hereby incorporated by reference, teaches a slide valve assembly that does not include a rackshaft connected to the volume slide valve member, but instead includes an self-positioning volume slide valve member that automatically slidably adjusts to control compressor volume ratio and power input to the compressor. However, it should be recognized that such adjustment is a function of time, rather than being instantaneous, at least with respect to large pressure changes in the compressor. One issue that may arise with the use of such a compressor is that when the compressor is stopped suddenly for any reason, the volume slide may stay at the offset position it was in immediately prior during operation, rather than adjusting back to an initial position. As a result, the compressor may experience over compression in the rotor grooves due to the volume slide offset position during the starting procedure.

SUMMARY

Compressors and methods of operating compressors are disclosed herein, in which the compressors include a slide valve assembly that has an self-adjusting volume slide valve member.

In at least a first aspect, a compressor including a slide valve assembly is provided, the compressor having at least three phases of operation, including start-up, normal operation, and shutdown. The compressor comprises a slide valve carriage, a capacity slide valve member secured to the slide valve carriage and slidably movable longitudinally with respect to the slide valve carriage, and a volume slide valve member secured to the slide valve carriage and slidably movable longitudinally with respect to the slide valve carriage. The volume slide valve member is self-positioning longitudinally with respect to the slide valve carriage based on a plurality of pressure forces exerted on the slide valve member during normal operation. The compressor further comprises a positioning assembly that includes a pinion gear and a movable volume rackshaft. The pinion gear moves the volume rackshaft longitudinally from a first position to a second position, wherein the volume rackshaft engages the volume slide valve member and moves the volume slide valve member to an initial position when the volume rackshaft moves from the first position to the second position.

In examples of such compressors, the slide valve assembly may not include a controller connected to the volume slide valve member to cause movement of the volume slide valve member during normal operation of the compressor. Similarly, the slide valve assembly may not include a control rackshaft that is connected to the volume slide valve member.

Additionally, examples of such compressors may include one or more of the following features. The volume rackshaft of the positioning assembly may include a first end having stop, and the stop engages the volume slide valve member when the volume rackshaft moves from the first position to the second position. The stop may engage the pinion gear when the volume rackshaft is in the first position. The volume rackshaft may be movable to a plurality of intermediate positions between the first position and the second position. The volume rackshaft may be in the first position during normal operation of the compressor. The compressor may any suitable type of compressor, such as a rotary gas compressor. The compressor may further comprise a control rackshaft connected to the capacity slide valve member.

In at least a second aspect, a method of operating a compressor having a slide valve assembly is provided. The compressor has at least three phases of operation, including start-up, normal operation, and shutdown. The method includes providing the compressor having the slide valve assembly. The slide valve assembly includes a slide valve carriage, a capacity slide valve member secured to the slide valve carriage and slidably movable longitudinally with respect to the slide valve carriage, and a volume slide valve member secured to the slide valve carriage and slidably movable longitudinally with respect to the slide valve carriage. The volume slide valve member is self-positioning longitudinally with respect to the slide valve carriage based on a plurality of pressure forces exerted on the slide valve member during normal operation. The compressor further comprises a positioning assembly that includes a pinion gear and a movable volume rackshaft. The pinion gear moves the volume rackshaft longitudinally from a first position to a second position, wherein the volume rackshaft engages the volume slide valve member and moves the volume slide valve member to an initial position when the volume rackshaft moves from the first position to the second position. The method also includes moving the volume slide valve member to an initial position prior to the normal operation phase of the compressor by the pinion gear moving the volume rackshaft longitudinally from a first position to a second position, wherein the volume rackshaft engages the volume slide valve member when the volume rackshaft moves from the first position to the second position. The method further includes adjusting the position of the slide valve member by self-positioning of the slide valve member in response to unbalanced forces during the normal operation phase, and operating the compressor in the normal operation phase under balanced conditions where there are balanced forces acting upon the volume slide member.

BRIEF DESCRIPTION OF THE DRAWINGS

Specific examples have been chosen for purposes of illustration and description, and are shown in the accompanying drawings, forming a part of the specification.

DETAILED DESCRIPTION

Slide valve assemblies of the present technology are generally intended for use in a variety of compressors. One exemplary compressor is a single rotary screw gas compressor adapted for use in a compression system (e.g., a refrigeration system), or the like.

FIGS. 3-6 illustrate of one example of a compressor 300 that includes slide valve assemblies 200 of the present technology. In the illustrated example, the compressor 300 is a rotary gas compressor for a refrigeration system, and is specifically a single screw rotary gas compressor. Compressors of the present technology have at least three phases of operation, which include start-up, normal operation, and shutdown.

Figure 1:
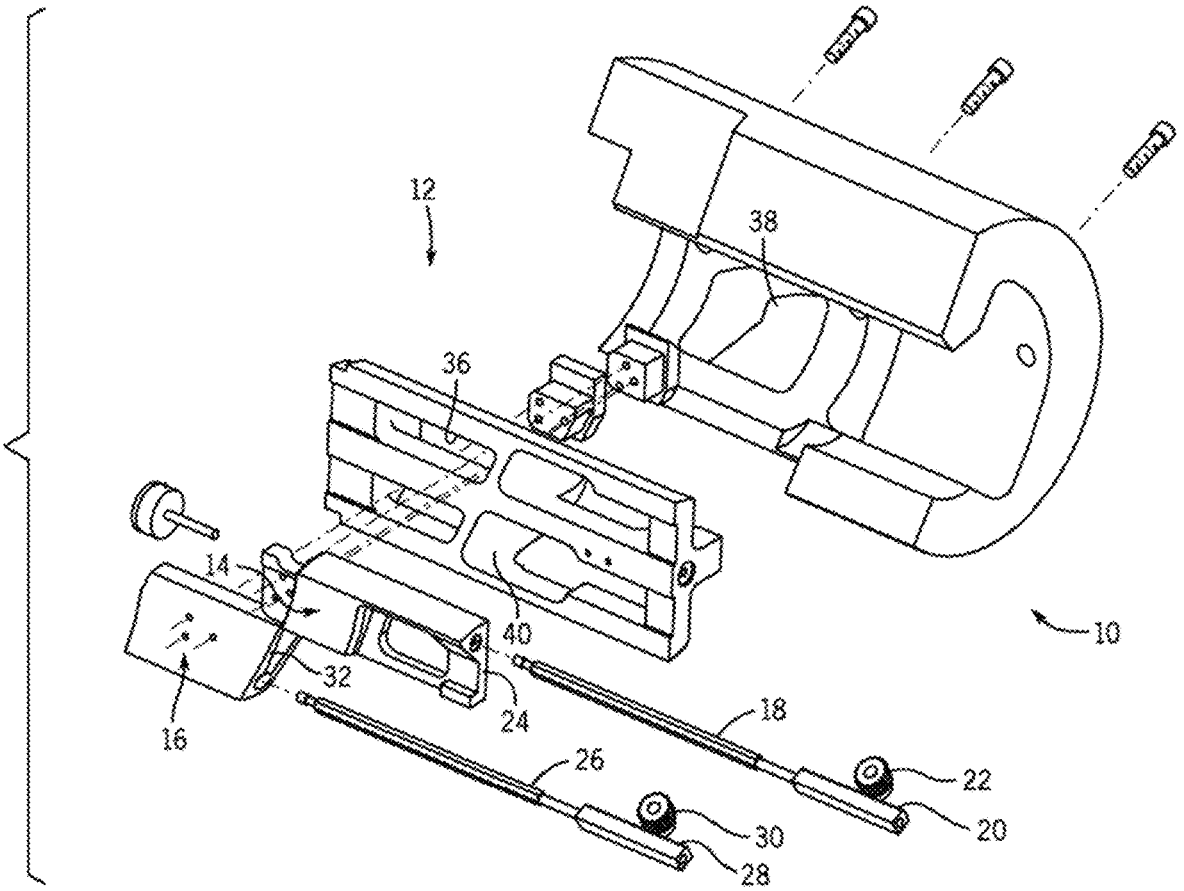
FIGURE 1 (PRIOR ART)
FIG. 1 illustrates an exploded view of one example prior art slide valve assembly showing the mechanisms for moving the slide valves.
Figure 2:
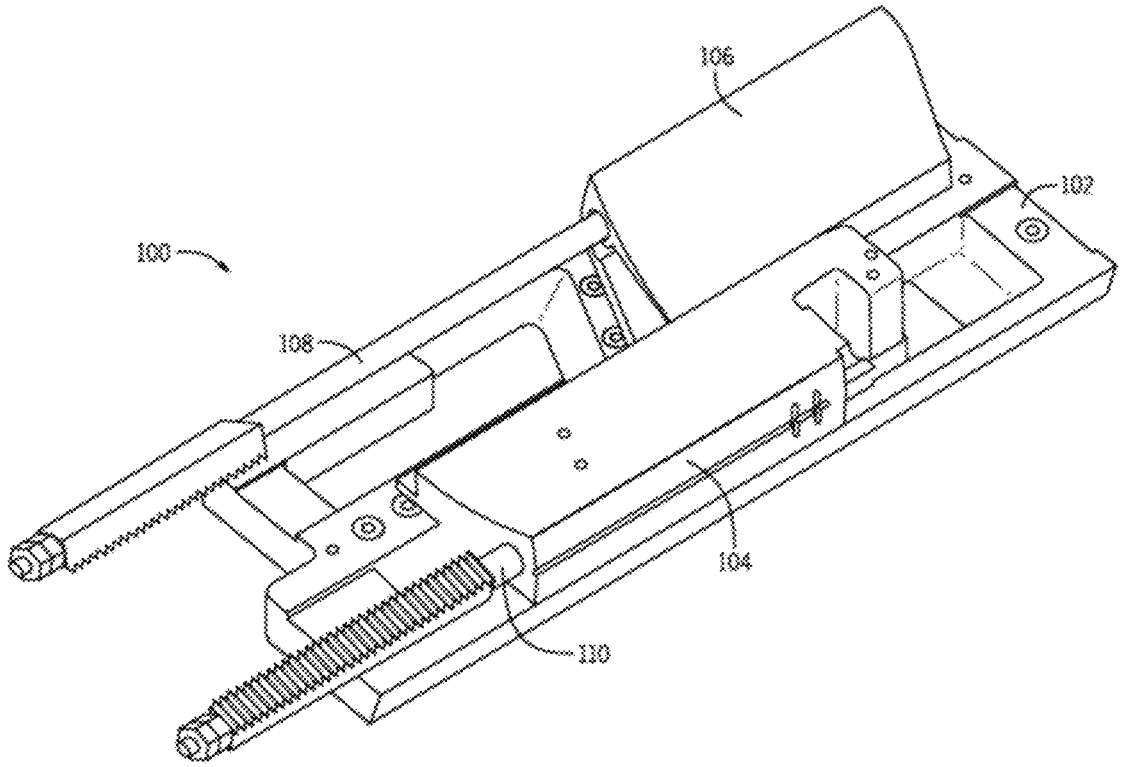
FIGURE 2 (PRIOR ART)
FIG. 2 illustrates a top perspective view of one example of a carriage and slide valve members of a prior art slide valve assembly.
Figure 3:
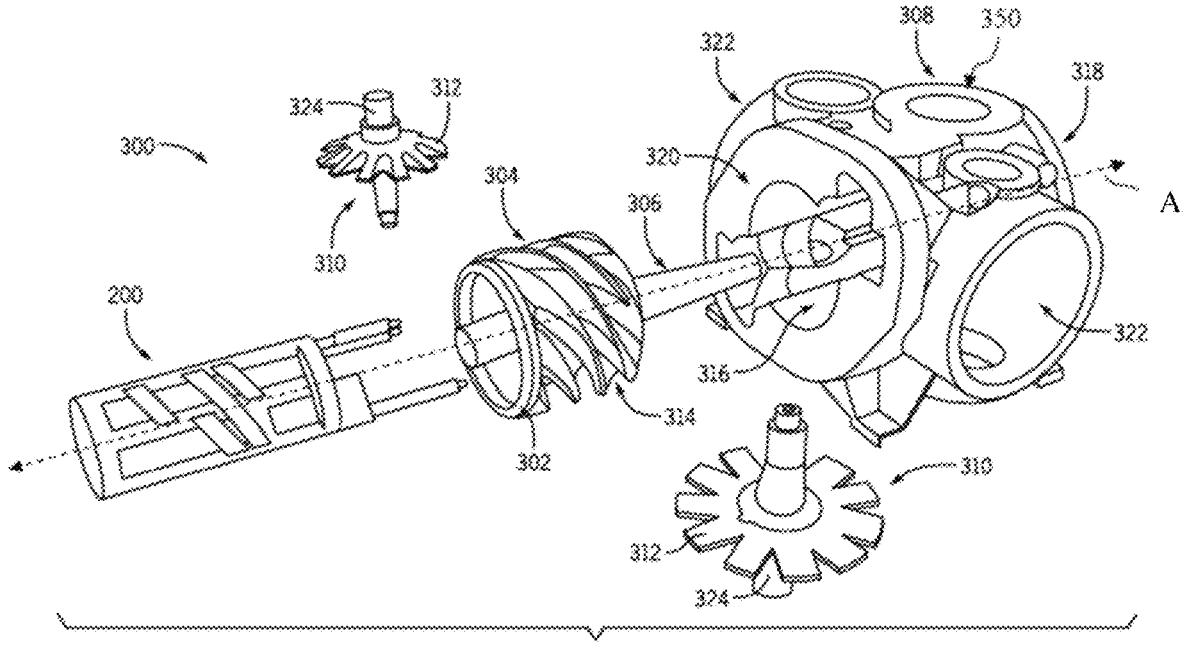
FIG. 3 illustrates an exploded view of a single screw compressor including the slide valve assembly of the present technology.
Figure 4:
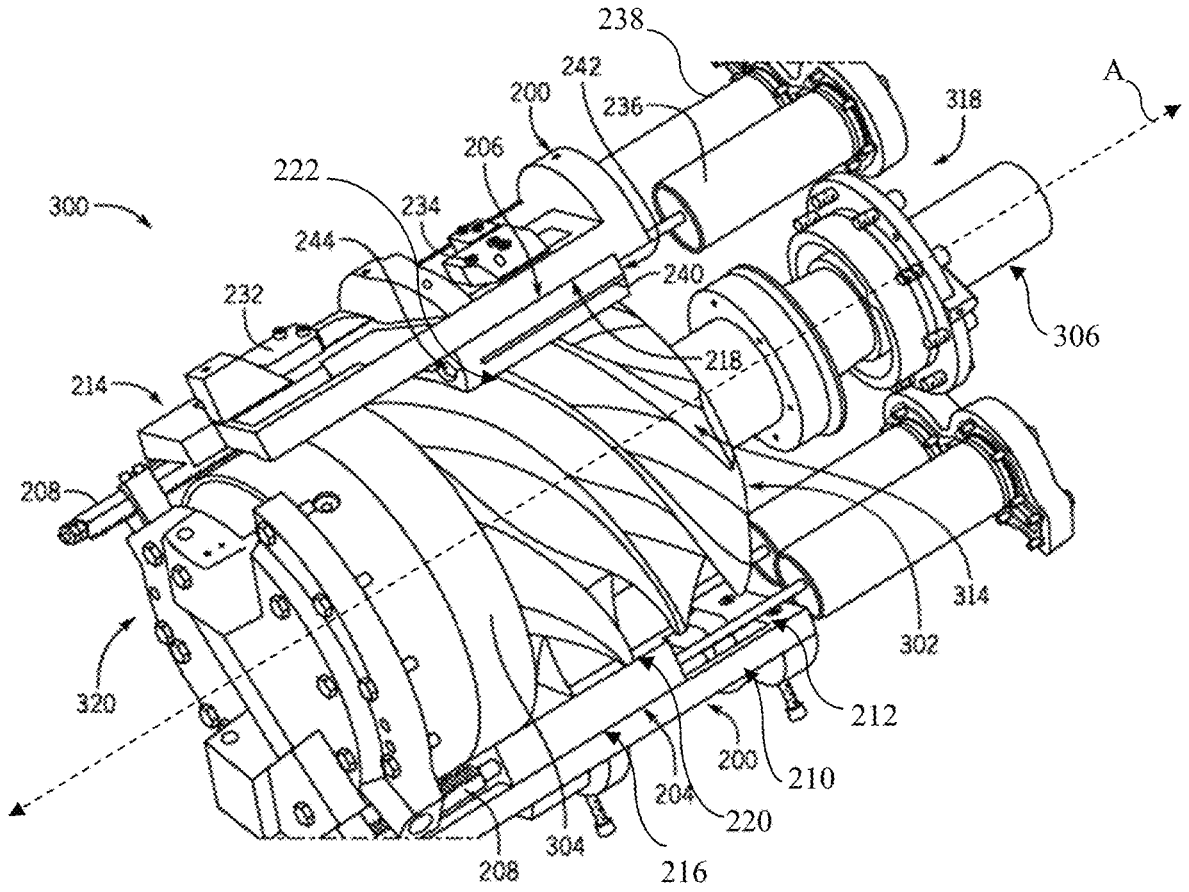
FIG. 4 illustrates a perspective view of a portion of the compressor of FIG. 3, without the housing.

As shown in FIGS. 3 and 4, the compressor 300 has a main rotor 302, which is helically grooved and has a cylindrical outer surface 304, and a rotor shaft 306. The rotor shaft 306 extends axially along a schematic central axis A. Compressor 300 also includes a compressor housing 308 (FIG. 3), and the main rotor 302 is mounted for rotation about the rotor shaft 306 within the compressor housing 308. A pair of star-shaped gate rotors 310 (FIG. 3), or star rotors, are also mounted for rotation in the compressor housing 308. Each gate rotor 310 has a plurality of gear teeth 312 that are configured to mesh with the helical grooves 314 of the main rotor 302.

Referring to FIG. 3, the compressor housing 308 generally includes a cylindrical bore 316 in which the main rotor is rotatably mounted. The cylindrical bore 316 may be open at its suction end 318 and may be closed at its discharge end 320 by a discharge end wall (not shown). The rotor shaft 306 of the main rotor 302 is rotatably supported at opposite ends on bearing assemblies (not shown) mounted on compressor housing 308. The compressor housing 308 typically includes spaces 322 therein in which the star rotors 310 are rotatably mounted and the gate rotors 310 are located on opposite sides (i.e., 180 degrees apart) of main rotor 302. Each of the gate rotors 310 has a plurality of gear teeth 312 and is provided with a gate rotor shaft 324 which is rotatably supported at opposite ends on the bearing assemblies (not shown) mounted on the compressor housing 308. Each of the gate rotors 310 typically rotate on a schematic axis which is perpendicular to and spaced from the schematic central axis A of main rotor 302 (the axis of rotation of the main rotor 302) and its gear teeth 312 extend through an opening communicating with cylindrical bore 316. During operation, each gear tooth 312 of each of the gate rotors 310 successively engages a groove in main rotor 302 as the latter is rotatably driven by a motor and, in cooperation with the wall of cylindrical bore 316 and specifically its end wall (not shown), defines a gas compression chamber. The housing 308 is provided with a gas suction port 350 and two gas discharge ports (not shown).

Referring to FIG. 4, compressor 300 includes two dual slide valve assemblies 200, which are mounted inside the compressor housing 308 (FIG. 3) and cooperate with the main rotor 302 to control gas flow into and from the compression chambers formed by the helical grooves 314 on the main rotor 302.

Figure 5:
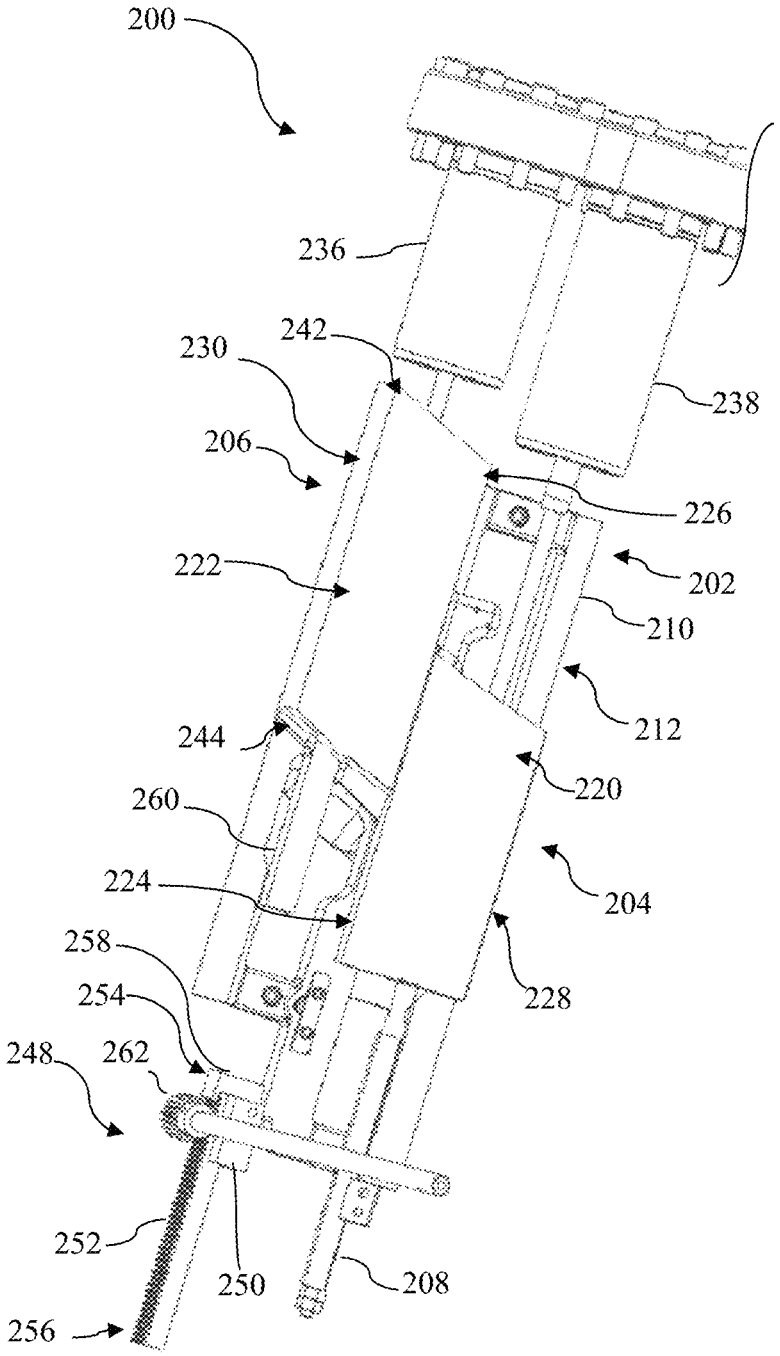
FIG. 5 illustrates a perspective view of a slide valve assembly of the present technology, with the volume rackshaft of the positioning assembly in a first position.
Figure 6:
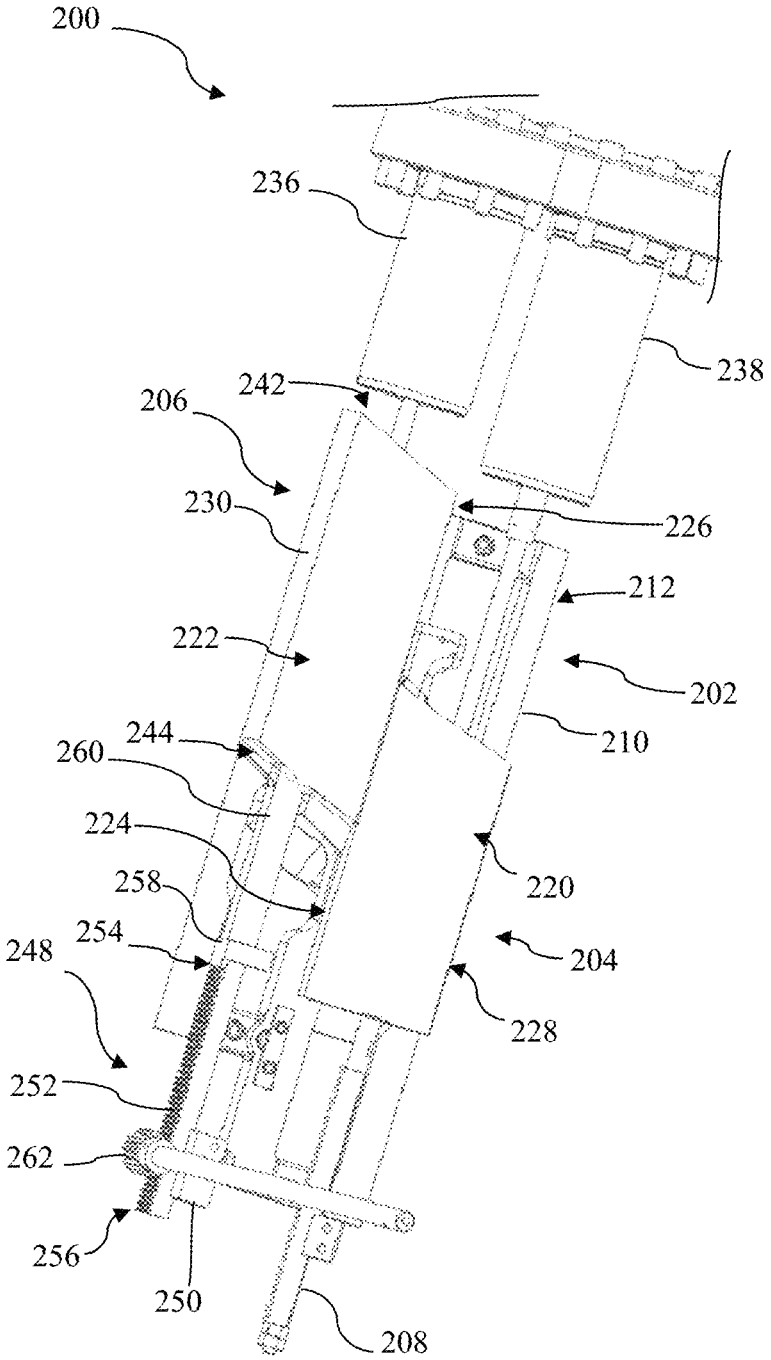
FIG. 6 illustrates a perspective view of the slide valve assembly of FIG. 5, with the volume rackshaft of the positioning assembly in a second position

As best shown in FIGS. 5 and 6, although like components are labeled with like reference numbers in FIGS. 3 and 4, a slide valve assembly 200 of the present technology includes a slide valve carriage 202, as well as two movable slide valve members, namely, a capacity slide valve member 204 and a volume slide valve member 206. The capacity slide valve member 204 controls the size of the suction port, thus affecting the capacity of the compressor. The volume slide valve member 206 controls the size and timing of the discharge port, thus affecting the efficiency of compression by controlling the "volume ratio" of the discharge pressure to suction pressure.

In contrast to currently known slide valve assemblies, slide valve assemblies 200 of the present technology include a volume slide valve member 206 that is not driven by a controller. Instead, the volume slide valve member 206 in the slide valve assembly 200 is self-positioning. As used herein, "self-positioning" means that the slide valve member 206 moves solely in response to differences in pressure between forces acting on the slide valve member 206 due to operation of the compressor 300, such as the groove pressure and the discharge pressure. For example, volume slide valve assemblies of the present technology do not include a controller or other position controlling apparatus, connected to the volume slide valve member. The slide valve assemblies of the present technology may also operate without other mechanical driving components associated with the volume slide valve member, such as a control rackshaft, as well as an electrical controller and the cables and software related to the controller.

Each of the movable slide valve members, the capacity slide valve member 204 and the volume slide valve member 206, is slidably secured to the slide valve carriage 202, and is slidably movable longitudinally, or axially, with respect to the carriage 202, parallel to the schematic axis of axial movement A of the compressor (FIG. 4). The volume slide valve member 206 and the capacity slide valve member 204 are independently movable. The volume slide valve member 206 is self-positioning, and automatically slidably adjusts its position to control compressor volume ratio and power input to the compressor. The capacity slide valve member 204 is slidably movable by a controller to control compressor capacity. More specifically, the capacity slide valve member 204 is connected to a first control rackshaft 208, which is driven by a controller (not shown) to move the capacity slide valve member 204 longitudinally, or axially, with respect to the carriage 202, parallel to the schematic axis of axial movement A, to a desired position. The volume slide valve member 206 is not connected to a control rackshaft, and is also not connected to a controller. The position of the volume slide valve member is thus not driven by a controller during normal operation of the compressor.

Referring to FIGS. 4, 5 and 6, carriage 202 includes a rectangular plate portion 210 having a front side 212 and a rear side 214 (FIG. 4). The capacity slide valve member 204 has a rear surface 216 (FIG. 4), which may be flat and smooth. The volume slide valve member 206 has a rear surface 218 (FIG. 4), which may be flat and smooth, and may include one or more bottom grooves. Referring to FIGS. 5 and 6, the capacity slide valve member 204 has a front surface 220 and the volume slide valve member 206 has a front surface 222. Front surfaces 220 and 222 can each be curved or contoured, and can also be smooth or substantially smooth. The capacity slide valve member 204 and the volume slide valve member 206 can also include inside surfaces 224 and 226, respectively, which can each be flat and smooth or substantially smooth. The capacity slide valve member 204 and the volume slide valve member 206 can further include outside surfaces 228 and 230, respectively, which can each be contoured or curved and smooth or substantially smooth. Referring to FIG. 4, the volume slide valve member 206 also has a first end surface 242 that faces the suction end 318 of the compressor 300, and a second end surface 244 that faces the discharge end 320 of the compressor 300. The volume slide valve member 206 can also include a volume low pressure outside groove 240 that can be formed or otherwise created in, and extend across a substantial portion of, or almost the entire extent of, an outside surface of the volume slide valve member 206.

Figure 8:
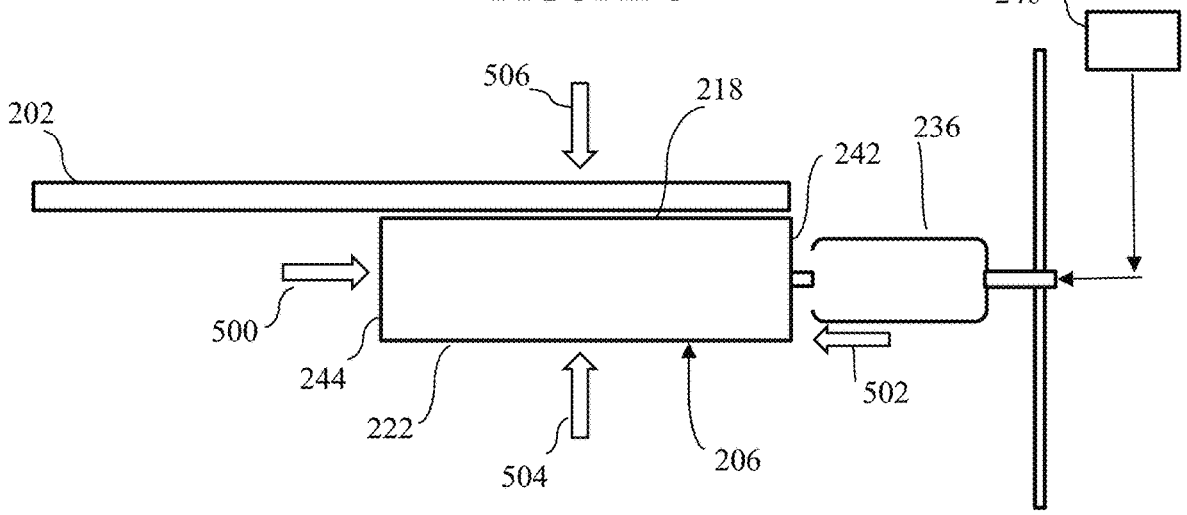
FIG. 8 illustrates a side view of a simplified representation of a volume slide member of the present technology, an initial position.
Figure 9:
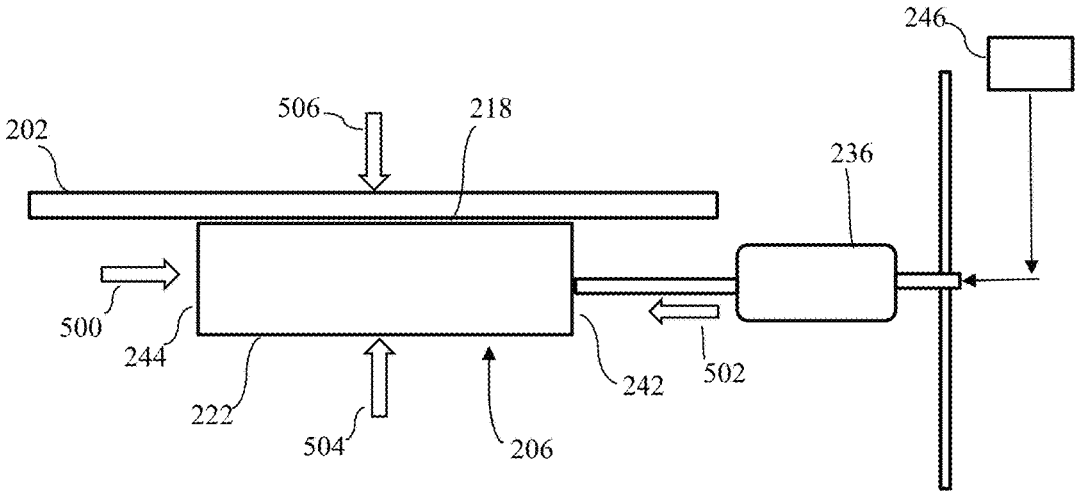
FIG. 9 illustrates the volume slide member of FIG. 8, in an intermediate position, which is a partial capacity position.
Figure 10:
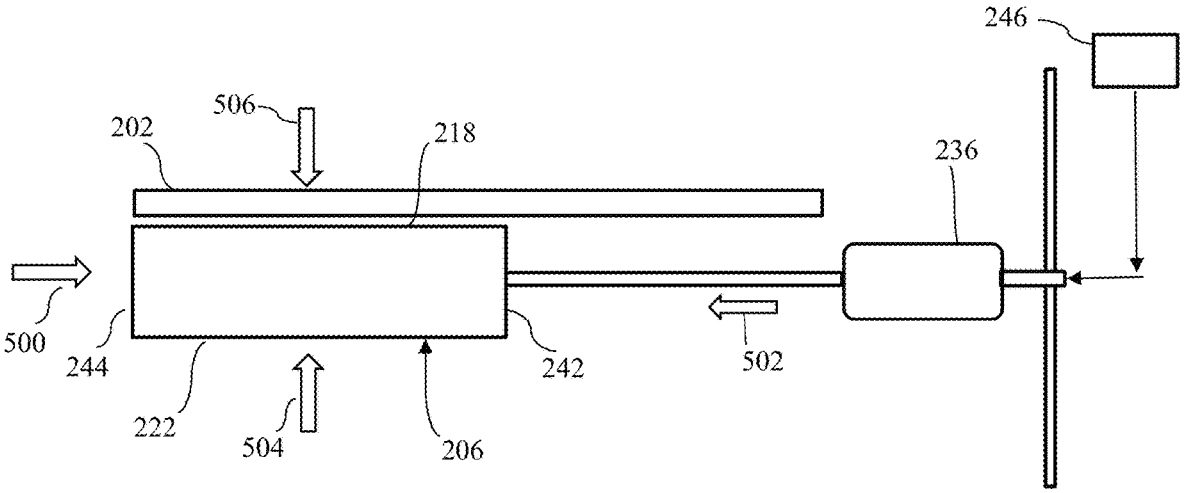
FIG. 10 illustrates the volume slide member of FIG. 8, in a full capacity position.

Referring to FIG. 4, the rear surface 216 of the capacity slide valve member 204 and the rear surface 218 of the volume slide valve member 206 each face towards and slide upon the front side 212 of the rectangular plate portion 210 of the slide valve carriage 202. Front surface 220 of the capacity slide valve member 204 and front surface 222 of the volume slide valve member 206 each face towards the cylindrical surface 304 of the main rotor 302. Referring to FIGS. 5 and 6, the inside surface 224 of the capacity slide valve member 204 and the inside surface 226 of the volume slide valve member 206 can slidably engage each other. The outside surface 228 of the capacity slide valve member 204 and the outside surface 230 of the volume slide valve member 206 can face towards and slidably engage a compressor structure, such as an inside wall of cylindrical bore 316 (FIG. 3). The slide valve assembly 200 also includes a volume slide valve balance piston 236, and a capacity slide valve balance piston 238, each of which is connected to the discharge gas 246 (FIGS. 8 through 10). Referring to FIG. 4, the capacity slide valve member 204 and the volume slide valve member 206 can be slidably secured to carriage 202, such as by capacity clamping member 232 and volume clamping member 234, which may be secured to the slide valve members by fasteners, such as screws or any other suitable type of fastener.

During operation, different portions of the volume slide valve member 206 are in contact with compression gasses at various stages of compression, and the compression gasses at those various stages of compression act on the portion of the volume slide valve member 206 that they contact. Referring to FIG. 4, initial compression gasses at suction pressure enter the main rotor 302 at the suction end 318. As the compression gasses travel through the compression chambers formed by the helical grooves 314, they become intermediate compression gasses, which have an increasing pressure as they travel from the suction end 318 towards the discharge end 320. When the compression gasses exit the helical grooves 314 they are discharge gasses and have a pressure that is discharge pressure. The gasses around the outside of the main rotor 302 and the initial compression gasses are at suction pressure, and therefore exert a force known as "suction pressure" on portions of the volume slide valve member 206. The discharge gasses that are discharged from the helical grooves 314 exert a force known as "discharge pressure" on portions of the volume slide valve member 206. The intermediate compression gasses, which have an increasing pressure as they travel from the suction end 318 towards the discharge end 320 exert a force known as "groove pressure" on portions of the volume slide valve member 206.

The compressor 300 is configured to provide balanced opposing pressures along the schematic axial axis of movement of the volume slide valve member 206, which is parallel to the schematic axis A of the compressor 300 (FIG. 4). Specifically, referring to FIG. 4, a first discharge pressure force is exerted on the second end surface 244 of the volume slide valve member 206 by the discharge gasses. To balance that first discharge pressure force, the slide valve assembly 200 includes a balance piston 236, which has connection to the discharge gasses 246 (FIGS. 8 through 10). The balance piston 236 exerts a second discharge pressure force on the first end surface 242 of the volume slide valve member 206, where the second discharge pressure force is equal to the first discharge pressure force since they are derived from the same discharge gasses.

Referring to FIGS. 4, 5 and 6, the volume slide valve member 206 is slidable longitudinally along the length of the rectangular plate portion 210 of the slide valve carriage 202. The volume slide valve member 206 has an initial position towards the suction end 318 of the compressor, and a full capacity position towards the discharge end 320 of the compressor. The volume slide valve member 206 is shown in its initial position in FIGS. 5, 6 and 8, and in its full capacity position in FIG. 10. As discussed more fully below, during normal operation of the compressor, the volume slide valve member 206 may move to any intermediate point between the initial position and the full capacity position. During start-up or shutdown of the compressor, it is desired for the volume slide valve member 206 to be in its initial position. However, when a compressor transitions from not operating to operating during start-up, or from operating to not operating during shut-down, the forces acting on the volume slide valve member 206 may experience sudden flux. In such situations, the forces acting on the volume slide valve member 206 may not result in the volume slide valve member 206 naturally self-positioning to the initial position.

Accordingly, referring to FIGS. 5 and 6, the slide valve assembly 200 includes a positioning assembly 248 that may include a rackshaft guide 250, a pinion gear 262, and a movable volume rackshaft 252. The volume rackshaft 252 has a first end 254 and a second end 256. The first end 254 may include a stop 258. The pinion gear 262 moves the volume rackshaft 252 longitudinally from a first position, shown in FIG. 5, to a second position, shown in FIG. 6. The stop 258 may engage the rackshaft guide 250 when the volume rackshaft 252 is in the first position. The volume rackshaft 252 may be movable to any of a plurality of intermediate positions between the first position and the second position.

The pinion gear 262 may move the volume rackshaft 252 longitudinally from the first position to the second position at any time before normal operation of the compressor, including during start-up and/or shutdown. As the volume rackshaft 252 moves from the first position to the second position, the volume rackshaft 252 encounters and engages the volume slide valve member 206. The volume rackshaft 252 thus moves, or pushes, the volume slide valve member 206 to its initial position as the volume rackshaft 252 moves from the first position to the second position. In the example shown in FIGS. 5 and 6, the volume rackshaft 252 is aligned longitudinally with at least a portion of the volume slide valve member 206. More particularly, the volume slide valve member 206 includes a tail 260, which is aligned longitudinally with the volume rackshaft 252. The stop 258 engages, or abuts, the pinion gear when the volume rackshaft 252 is in the first position. The stop 258 and the stop engages, and pushes against, the tail 260 of the volume slide valve member 206 when the volume rackshaft 252 moves from the first position to the second position. The pinion gear 262 may then retract the volume rackshaft 252, moving the volume rackshaft 252 longitudinally from the second position to the first position, leaving the volume slide valve member 206 in its initial position, before normal operation of the compressor. In this manner, the volume slide valve member 206 is ensured to be at its initial position during startup, before normal operation of the compressor.

The volume rackshaft 252 may, at least usually, be the first position during normal operation of the compressor. However, in some examples, such as when it is desirable to prevent the compressor from operating at full volume position, the pinion gear 262 may move the volume rackshaft 252 to a desired intermediate position and maintain the volume rackshaft 252 in that intermediate position during normal operation of the compressor.

Figure 7:
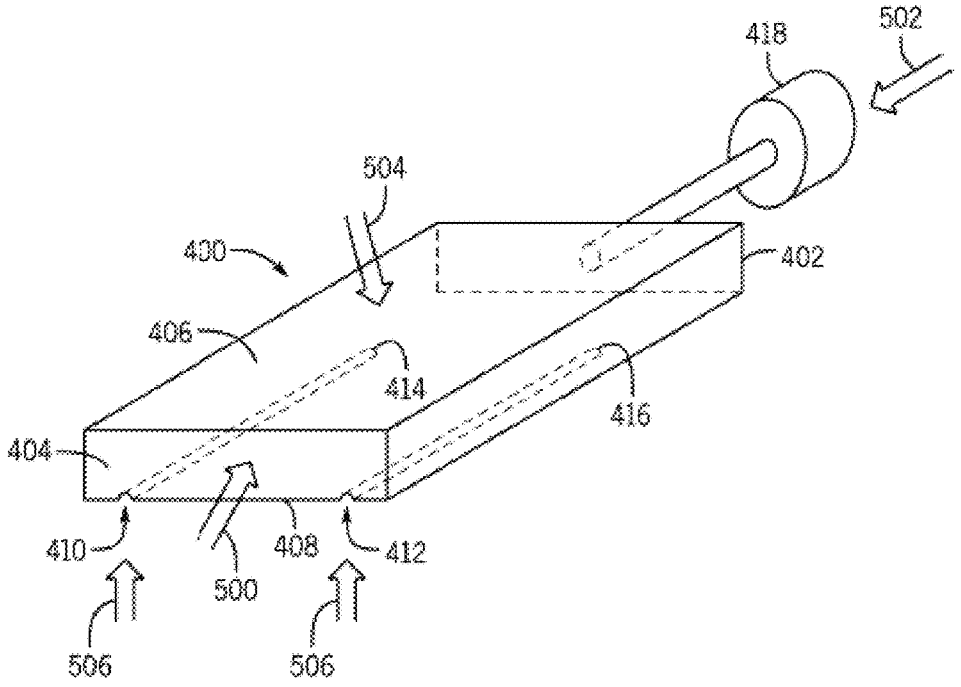
FIG. 7 illustrates perspective view of a simplified representation of a volume slide member of the present technology, and the forces that act on the volume slide member during operation.

An example of the forces acting on the volume slide valve member in a slide valve assembly 200 of the present technology, in both the axial and radial directions, can best be seen in FIG. 7. FIG. 7 illustrates a simplified version of a volume slide valve member 400, with the forces that act on the volume slide during operation. It should be understood that in an actual compressor, the volume slide valve member 400 can have any of the features (e.g., grooves and/or surfaces) of volume slide valve member 206 as described above, and the volume slide valve member 206 can have any of the features (e.g., grooves and/or surfaces) described with respect to volume slide valve member 400.

As shown in FIG. 7, the volume slide valve member 400 has a first end surface 402, a second end surface 404, a front surface 406 and a rear surface 408. The rear surface 408 of the volume slide valve member 400 may have one or more bottom grooves, such as first bottom groove 410 and second bottom groove 412. Each of the bottom grooves may extend along a portion of the length of the rear surface 408 of the volume slide valve member 400, or along the entirety of the length of the rear surface 408 of the volume slide valve member 400. In FIG. 7, the first bottom groove 410 extends along extends along a portion of the length of the rear surface 408 of the volume slide valve member 400 and has a terminal end 414, and second bottom groove 412 extends along a portion of the length of the rear surface 408 of the volume slide valve member 400 and has a terminal end 416.

The compressor (which may be compressor 300) is configured to provide balanced pressures along the axial axis of movement the volume slide valve member 400. Specifically, a first discharge pressure force 500 is exerted on the second end surface 404 of the volume slide valve member 400 by the discharge gasses. To balance that first discharge pressure force, the slide valve assembly includes a balance piston 418, which is connected to the discharge gasses (not shown). The balance piston 418 exerts a balance piston force 502 on the first end surface 402 of the volume slide valve member 400. The balance piston force 502 during operation of the compressor is a second discharge pressure force that is provided by the connection to the discharge gasses (not shown), and this is equal to the first discharge pressure force 500.

In a radial direction, which is perpendicular to the axial direction, there is a groove pressure force 504 acting on the front surface 406 of the volume slide member 400. There is a countering pressure force 506, which is equal to the discharge pressure and acts within the one or more bottom grooves, which may be first bottom groove 410 and second bottom groove 412.

Since the forces applied to the volume slide member 400 are designed to be balanced when the compressor is operating in a state of ideal compression, a slight change in the groove pressure due to an incorrect volume slide location will induce a different pressure near the second end surface 404, which will create an unbalanced system. In response, the volume slide member 400 will self-position by moving due to the unbalanced forces, until the groove pressure is identical to the discharge pressure, resulting in an ideal position/compression in all cases at any conditions.

FIGS. 8 through 10 illustrate the forces described above with respect to FIG. 7 as applied to the volume slide valve member 206 in a slide valve assembly 200, during operation of a compressor 300. FIGS. 8 through 10 illustrate side view of a simplified version of a volume slide valve member 206, the slide valve carriage 202, and the volume slide valve balance piston 236. In each of FIGS. 8 through 10, the volume slide valve balance piston 236 is connected to the discharge gas 246.

In FIG. 8, the volume slide valve member 206 is in an initial position, which is the desired position during start-up of the compressor. If the length of the slide valve carriage 202 is viewed as a spectrum of the range of motion for the volume slide valve member 206 from right to left, the initial position of the volume slide valve member 206 as shown can be thought of as being a 0% position.

In FIG. 9, the volume slide valve member 206 is in an intermediate position, which is one potential position during operation of the compressor. Although a specific intermediate position is shown, it should be understood that there are a potentially infinite number of intermediate positions, since the volume slide valve member may move to any point between the initial position and the full capacity position shown in FIG. 10, and each such position is an intermediate position.

In FIG. 10, the volume slide valve member 206 is in a full capacity position, or 100% position. The full capacity position shown is one potential position during operation of the compressor, and occurs when the compressor is operating at full capacity.

Referring to FIGS. 9 and 10, during normal operation of the compressor (which may be compressor 300), a first discharge pressure force 500 is exerted on the second end surface 244 of the volume slide valve member 206 by the discharge gasses. To balance that first discharge pressure force, volume slide valve balance piston 236 exerts a balance piston force 502 on the first end surface 242 of the volume slide valve member 206. Because the balance piston 236 is connected to the discharge gasses 246, the balance piston force 502 is a second discharge pressure force, which is equal to the first discharge pressure force 500.

In a radial direction (up and down as shown in FIGS. 9 and 10), which is perpendicular to the axial direction (left and right as shown in FIGS. 9 and 10), there is a groove pressure 504 acting on the front surface 222 of the volume slide valve member 206, which is generated by the intermediate gasses. There is a countering pressure force 506, which is equal to the discharge pressure and acts on the rear surface 218 of the volume slide valve member 206. The countering pressure force 506 may act within one or more bottom grooves of the volume slide valve member 206 (such as bottom grooves 410 and 412 as shown in FIG. 7).

Since the forces applied to the volume slide valve member 206 are designed to be balanced when the compressor is operating in a state of ideal compression, changes in the groove pressure 504 during operation of the compressor due to an incorrect volume slide location will induce a different pressure near the second end surface 244, which will create an unbalanced system. In response, the volume slide valve member 206 will self-position by moving due to the unbalanced forces, until the groove pressure is identical to the discharge pressure, resulting in reestablishing an ideal position/compression.

Figure 11:
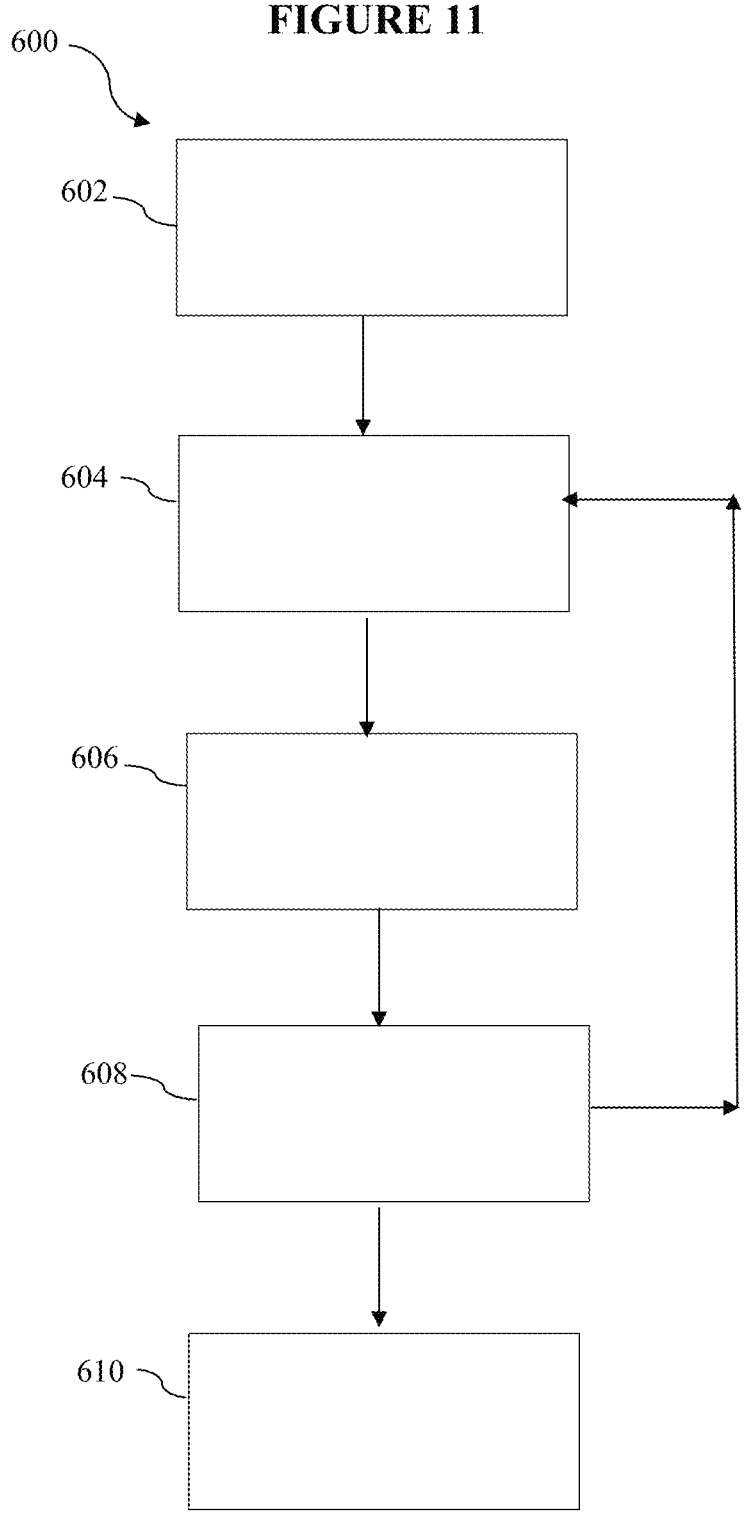
FIG. 11 is a flow diagram of one example of a method of operation of a compressor having a slide valve assembly of the present technology.

FIG. 11 is a flow diagram of one example of a method of operation of a compressor having a slide valve assembly of the present technology, such as slide valve assembly 200 as shown in FIGS. 3-6. The compressor has at least three phases of operation, including start-up, normal operation, and shutdown. The slide valve assembly used in the method includes at least a slide valve carriage, a volume slide valve member secured to the slide valve carriage and slidably movable longitudinally with respect to the slide valve carriage, and a capacity slide valve member secured to the slide valve carriage and slidably movable longitudinally with respect to the slide valve carriage. The capacity slide valve member may be slidably movable longitudinally by a controller, and may be connected to the controller by a control rackshaft. The volume slide valve member is be self-positioning longitudinally. The volume slide valve member is not connected to a control rackshaft or a controller. The slide valve assembly may also include a positioning assembly that includes a pinion gear and a movable volume rackshaft, wherein the pinion gear moves the volume rackshaft longitudinally from a first position to a second position, wherein the volume rackshaft engages the volume slide valve member and moves the volume slide valve member to an initial position when the volume rackshaft moves from the first position to the second position.

The method 600 starts at step 602, which includes moving the volume slide valve member to an initial position prior to the normal operation phase of the compressor, which may be during start-up. Moving the volume slide valve member to the initial position may include the pinion gear moving the volume rackshaft longitudinally from a first position to a second position, such that the volume rackshaft engages the volume slide valve member when the volume rackshaft moves from the first position to the second position. The method may further include moving the volume rackshaft longitudinally from the second position to the first position after moving the volume slide valve member to the initial position and before the normal operation phase.

The method continues to step 604, which includes operating the compressor in the normal operation phase.

The method continues to step 606, which includes adjusting the position of the slide valve member by self-positioning of the slide valve member in response to unbalanced forces during the normal operation phase. Unbalanced forces that occur during the normal operation phase and act upon the volume slide member may be due to a difference between the discharge pressure and the groove pressure. In some examples of such circumstances, the discharge pressure may be greater than the groove pressure. In other examples of such circumstances, the discharge pressure may be less than the groove pressure. The slide valve member self-positions by adjusting its position until the groove pressure equals the discharge pressure. In methods of the present technology, there is not a controller or other position controlling apparatus connected to slide valve member that moves the controller. Instead, the slide valve member moves solely in response to differences in pressure between the groove pressure and the discharge pressure. When the compressor is operating in under compression, where the discharge pressure is greater than the groove pressure, then the slide valve member may adjust its position by self-positioning in a first direction. When the compressor is operating in over compression, where the discharge pressure is less than the groove pressure, then the slide valve member may adjust its position by self-positioning in a second direction longitudinally opposite of the first direction.

Once the slide valve member self-positions by adjusting its position until the groove pressure equals the discharge pressure, the method next continues to step 608, which includes operating the compressor in the normal operation phase under balanced conditions where there are balanced forces acting upon the volume slide member. As the compressor continues to operate, other operation conditions may occur that cause the forces acting upon the volume slide member to once again become unbalanced, and the method may go back to step 604.

The method may further include step 610, which includes operating the compressor in the shutdown phase. Step 610 may include performing step 602. In other words, operating the compressor in the shutdown phase may include moving the volume slide valve member to the initial position may include the pinion gear moving the volume rackshaft longitudinally from a first position to a second position, such that the volume rackshaft engages the volume slide valve member when the volume rackshaft moves from the first position to the second position.

Accordingly, the pinion gear may move the volume rackshaft longitudinally from the first position to the second position before normal operation of the compressor, including during start-up and/or shutdown. As the volume rackshaft moves form its first position to its second position, it encounters and engages the volume slide valve member, and moves the volume slide valve member to its initial position. The pinion gear may then retract the volume rackshaft, moving the volume rackshaft longitudinally from the second position to the first position, leaving the volume slide valve member in its initial position, before normal operation of the compressor. In this manner, the volume slide valve member is ensured to be at its initial position during startup, before normal operation of the compressor.

From the foregoing, it will be appreciated that although specific examples have been described herein for purposes of illustration, various modifications can be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A compressor including a slide valve assembly, the compressor having at least three phases of operation, including start-up, normal operation, and shutdown, the compressor comprising:

a slide valve carriage;

a capacity slide valve member secured to the slide valve carriage and slidably movable longitudinally with respect to the slide valve carriage a volume slide valve member secured to the slide valve carriage and slidably movable longitudinally with respect to the slide valve carriage, wherein the volume slide valve member is self-positioning longitudinally with respect to the slide valve carriage based on a plurality of pressure forces exerted on the slide valve member during normal operation; and a positioning assembly that includes a pinion gear and a movable volume rackshaft, wherein the pinion gear moves the volume rackshaft longitudinally from a first position to a second position, wherein the volume rackshaft engages the volume slide valve member and moves the volume slide valve member to an initial position when the volume rackshaft moves from the first position to the second position.

2. The compressor of claim 1, wherein the volume rackshaft includes a first end having stop, and the stop engages the volume slide valve member when the volume rackshaft moves from the first position to the second position.

3. The compressor of claim 2, wherein the positioning assembly further includes a rackshaft guide, and the stop engages the rackshaft guide when the volume rackshaft is in the first position.

4. The compressor of claim 1, wherein the volume rackshaft is movable to a plurality of intermediate positions between the first position and the second position.

5. The compressor of claim 1, wherein the volume rackshaft is the first position during normal operation of the compressor.

6. The compressor of claim 1, wherein the compressor is a rotary gas compressor.

7. The compressor of claim 1, further comprising a control rackshaft connected to the capacity slide valve member.

8. The compressor of claim 1, wherein the slide valve assembly does not include a controller connected to the volume slide valve member to cause movement of the volume slide valve member during normal operation of the compressor.

9. A compressor including a slide valve assembly, the compressor having at least three phases of operation, including start-up, normal operation, and shutdown, the compressor comprising:

a slide valve carriage;

a capacity slide valve member secured to the slide valve carriage and slidably movable longitudinally with respect to the slide valve carriage;

a volume slide valve member secured to the slide valve carriage and slidably movable longitudinally with respect to the slide valve carriage, wherein the slide valve assembly does not include a controller connected to the volume slide valve member to cause movement of the volume slide valve member during normal operation of the compressor, and the volume slide valve member is self-positioning longitudinally with respect to the slide valve carriage based on a plurality of pressure forces exerted on the slide valve member; and a positioning assembly that includes a pinion gear and a movable volume rackshaft, wherein the pinion gear moves the volume rackshaft longitudinally from a first position to a second position, wherein the volume rackshaft engages the volume slide valve member and moves the volume slide valve member to an initial position when the volume rackshaft moves from the first position to the second position.

10. The compressor of claim 9, wherein the volume rackshaft includes a first end having stop, and the stop engages the volume slide valve member when the volume rackshaft moves from the first position to the second position.

11. The compressor of claim 10, wherein the positioning assembly further includes a rackshaft guide, and the stop engages the rackshaft guide when the volume rackshaft is in the first position.

12. The compressor of claim 9, wherein the volume rackshaft is movable to a plurality of intermediate positions between the first position and the second position.

13. The compressor of claim 9, wherein the volume rackshaft is the first position during normal operation of the compressor.

14. The compressor of claim 9, wherein the compressor is a rotary gas compressor.

15. The compressor of claim 9, further comprising a control rackshaft connected to the capacity slide valve member.

16. A method of operating a compressor having a slide valve assembly, wherein the compressor has at least three phases of operation, including start-up, normal operation, and shutdown, the method comprising:

providing the compressor having the slide valve assembly, the slide valve assembly including:

a slide valve carriage;

a volume slide valve member secured to the slide valve carriage and slidably movable longitudinally with respect to the slide valve carriage, the volume slide valve member being self-positioning along the axis of movement;

a capacity slide valve member secured to the slide valve carriage and slidably movable longitudinally with respect to the slide valve carriage, the capacity slide valve member being slidably movable by a controller to control compressor capacity; and a positioning assembly that includes a pinion gear and a movable volume rackshaft, wherein the pinion gear moves the volume rackshaft longitudinally from a first position to a second position;

moving the volume slide valve member to an initial position prior to the normal operation phase of the compressor by the pinion gear moving the volume rackshaft longitudinally from a first position to a second position, wherein the volume rackshaft engages the volume slide valve member when the rackshaft moves from the first position to the second position;

adjusting the position of the slide valve member by self-positioning of the slide valve member in response to unbalanced forces during the normal operation phase; and operating the compressor in the normal operation phase under balanced conditions where there are balanced forces acting upon the volume slide member.

17. The method of claim 16, wherein the unbalanced forces acting upon the volume slide member include a difference between a discharge pressure and a groove pressure, and self-positioning of the slide valve member includes the slide valve member adjusting its position until the groove pressure equals the discharge pressure.

18. The method of claim 16, further comprising:

moving the volume rackshaft longitudinally from the second position to the first position after moving the volume slide valve member to the initial position and before the normal operation phase.

* * * * *